US006779949B2

(12) United States Patent
Barras et al.

(10) Patent No.: US 6,779,949 B2
(45) Date of Patent: Aug. 24, 2004

(54) DEVICE FOR TRANSFERRING A FLUID BETWEEN AT LEAST TWO FLOATING SUPPORTS

(75) Inventors: Steven Alexander Barras, Houston, TX (US); Pierre Savy, La Celle Saint Cloud (FR); Didier B. Renard, Houston, TX (US); Gene Raborn, Humble, TX (US); Louis George Bill, Houston, TX (US); Philippe François Espinasse, Bihorel (FR)

(73) Assignee: COFLEXIP (FR)

( * ) Notice: Subject to any disclaimer, the term of this patent is extended or adjusted under 35 U.S.C. 154(b) by 0 days.

(21) Appl. No.: 10/257,899

(22) PCT Filed: Apr. 20, 2001

(86) PCT No.: PCT/FR01/01227

§ 371 (c)(1),
(2), (4) Date: Oct. 15, 2002

(87) PCT Pub. No.: WO01/83291

PCT Pub. Date: Nov. 8, 2001

(65) Prior Publication Data

US 2003/0091396 A1 May 15, 2003

(30) Foreign Application Priority Data

Apr. 28, 2000 (FR) ..... 00 05456

(51) Int. Cl.[7] ..... F16L 1/038; E02D 23/00
(52) U.S. Cl. ..... 405/195.1; 405/155; 405/158
(58) Field of Search ..... 405/195.1, 155, 405/158, 169

(56) References Cited

U.S. PATENT DOCUMENTS 4,096,705 A 6/1978 Lamy ..... 61/111
4,182,584 A * 1/1980 Panicker et al. ..... 405/224.3
5,437,518 A * 8/1995 Maloberti et al. ..... 405/169
5,885,028 A * 3/1999 Blanchard et al. ..... 405/210

FOREIGN PATENT DOCUMENTS

| | | |
|---|---|---|
| AU | 526574 | 1/1983 |
| FR | 2768993 | 4/1999 |
| GB | 2335723 | 9/1999 |

OTHER PUBLICATIONS

PCT International Search Report for corresponding International Appln. No. PCT/FR/01227 dated Aug. 21, 2001.

"Recommended Practice for Flexible Pipe", *American Petroleum Institute*, Exploration and Production Dept., API Recommended Practice 17B, Second Edition: Jul. 1, 1998, Effective Date: Dec. 1, 1998, pp. 1–132.

"Specification for Unbonded Flexible Pipe", *American Petroleum Institute*, Exploration and Production Dept., API Specification 17J, First Edition: Dec. 1996, Effective Date: Mar. 1, 1997, pp. 1–42.

* cited by examiner

*Primary Examiner*—Heather Shackelford
*Assistant Examiner*—Lisa M. Saldano
(74) *Attorney, Agent, or Firm*—Ostrolenk, Faber, Gerb & Soffen, LLP

(57) ABSTRACT

For transferring a fluid between at least two floating supports or one floating and one fixed support, a rigid hollow transport line is immersed with a cable suspension system in the sea. A flexible connector links each end of the rigid transport line to one of the supports. The entire rigid transport line including its ends is immersed in the sea at a depth which is greater than the turbulent zone of the sea. Each connector provides continuity of oil flow between the two floating supports via the rigid transport line.

16 Claims, 4 Drawing Sheets

DEVICE FOR TRANSFERRING A FLUID BETWEEN AT LEAST TWO FLOATING SUPPORTS

BACKGROUND OF THE INVENTION

The present invention relates to a device in an offshore oil production installation for transferring a fluid between at least two floating supports such as a production vessel producing a gas-free product (dead oil) from live crude and a loading buoy (CALM buoy) from which oil tankers are filled with the product to be transported to land (onshore).

The production vessel having an acronym FPSO (Floating Production Storage Offloading) is generally anchored in a zone where the live crude is produced and is separated from the CALM buoy by several kilometers of the order of 1 to 3 kilometers.

The device for transferring the dead oil from the production vessel to the CALM buoy consists of at least one line known as an export line, one end of which is connected to the production vessel and the other end of which is connected to the CALM buoy. These export lines consist of a flexible pipe or rigid tube as described in API 17B, 17J and 5CT (American Petroleum Institute).

When the export line is built rigid, the connections at its ends are provided by kinds of ball joints (flex joints) so as to allow the export line to follow, on the other hand, the relative movements of each of the floating supports and, on the other hand, to more or less absorb the influences of the swell and marine currents likely to be present down to a certain depth in the sea. It is known from GB 2 335 723 to replace the conventional ball joint by flexible connecting means connecting the end of the rigid transport line to one of the floating supports and ensuring the continuity of flow of the crude between the two floating supports via the rigid transport line. However, according to this reference, the flexible pipe which replaces the conventional connection has the same dimensions as that connection, on order of a few meters. The rigid pipe stays partially submerged in a turbulent zone, and, consequently, the ends of the pipe undergo vibrations due to high marine currents. These vibrations in combination with the tensile forces cause early fatigue of the rigid pipe.

As the floating supports concerned can move independently of one another, and in any arbitrary direction, over a distance which is considered to be approximately equal to about 10% of the water depth of the sea on which the said supports are afloat, the amplitude of the relative movement between the two structures may thus be of the order of 20% of the said depth.

In order to allow these relative moments which may represent from 10 to 50% of the distance between the floating supports, it is common practice to provide an export line of a length much greater than the distance separating the two floating supports.

Furthermore, dynamic loadings in bending and vibrations are generated in the standing part of the export line by the movement of the swell, the marine current and the relative displacements of the supports. In addition, tensions are also created at the ends of the export line, these tensions being due mainly to the weight of the said export line.

The combination of the dynamic loadings, of the vibrations and of the tensions leads to significant fatigue of the export line at the end connections, which significantly reduces the life of the export line.

In the case of a rigid tube and in order to reduce vibration, the zones subjected to significant vibrations are equipped with additional special-purpose means such as anti-vibration strakes, for example. However, a solution such as this leads to additional cost of manufacture of the export line.

In order to reduce the tension caused by the weight of the line and to limit the tension at the ends, buoys with positive buoyancy have been widely used to create a single or double wave between the two floating supports. The series (of which there may be more than one) of buoys corresponding to the waves formed along the length of the export line gives the export line an additional length between its ends, which makes it possible to absorb the differences in length that are due to the relative displacements of the floating supports and for this to be possible under the most unfavourable operating conditions, that is to say when the said floating supports are moving in opposite directions.

One disadvantage of having buoys of positive buoyancy on the export line lies in the fact that the cost of the said export line is increased significantly without in any way solving the problems associated with the bending moments generated by the dynamic loadings or those associated with the vibrations caused by marine currents in particular.

In addition, by reducing the apparent weight of the export line, the latter tends to move with not insignificant amplitudes of movement as a function of the marine currents. These repeated movements lead to significant fatigue, mainly at the connections with the floating supports.

Another solution consists in laying the rigid export line on the seabed and in connecting its ends to the floating supports by risers. However, the length of such an installation is entirely prohibitive and cannot really be envisaged for great depths.

SUMMARY OF THE INVENTION

The object of the present invention is to overcome the aforementioned drawbacks by dissociating the bending moments developed by the movements of the floating supports and the vibrations from the tensile loadings developed by the weight of the export line.

The present invention concerns a device for transferring fluid between two floating supports at the surface of the sea, wherein the sea has a turbulent zone determined over a given depth. The device comprises a rigid hollow transport line which is submerged catenary-fashion in the sea. Flexible connecting means connect each end of the rigid transport line to one of the floating supports. The said connecting means ensure continuity of flow of the crude between the two floating supports via the rigid transport line. The entire rigid transport line including its ends is submerged in the sea to a depth greater than the turbulent zone.

What happens is that for a given region of the exploited oil field, the specialists can quite easily determine the height of the layer of water (turbulent zone) beneath which the movements of the swell are relatively small and in which the marine currents are weak, that is to say, in practice, a maximal speed of the marine currents less than 1 m/s or even 0.5 m/s. According to the invention, the rigid pipe is submerged within a non turbulent zone, defined by these speeds.

Each flexible and deformable connection connecting one end of the export line to the corresponding floating support absorbs all the dynamic bending stresses and vibrations without the need for additional special-purpose equipment.

BRIEF DESCRIPTION OF THE DRAWINGS

Other advantages and characteristics will become apparent from reading the description of a number of embodiments of the invention and from the appended drawings, in which.

DESCRIPTION OF PREFERRED EMBODIMENTS

Figure 1:
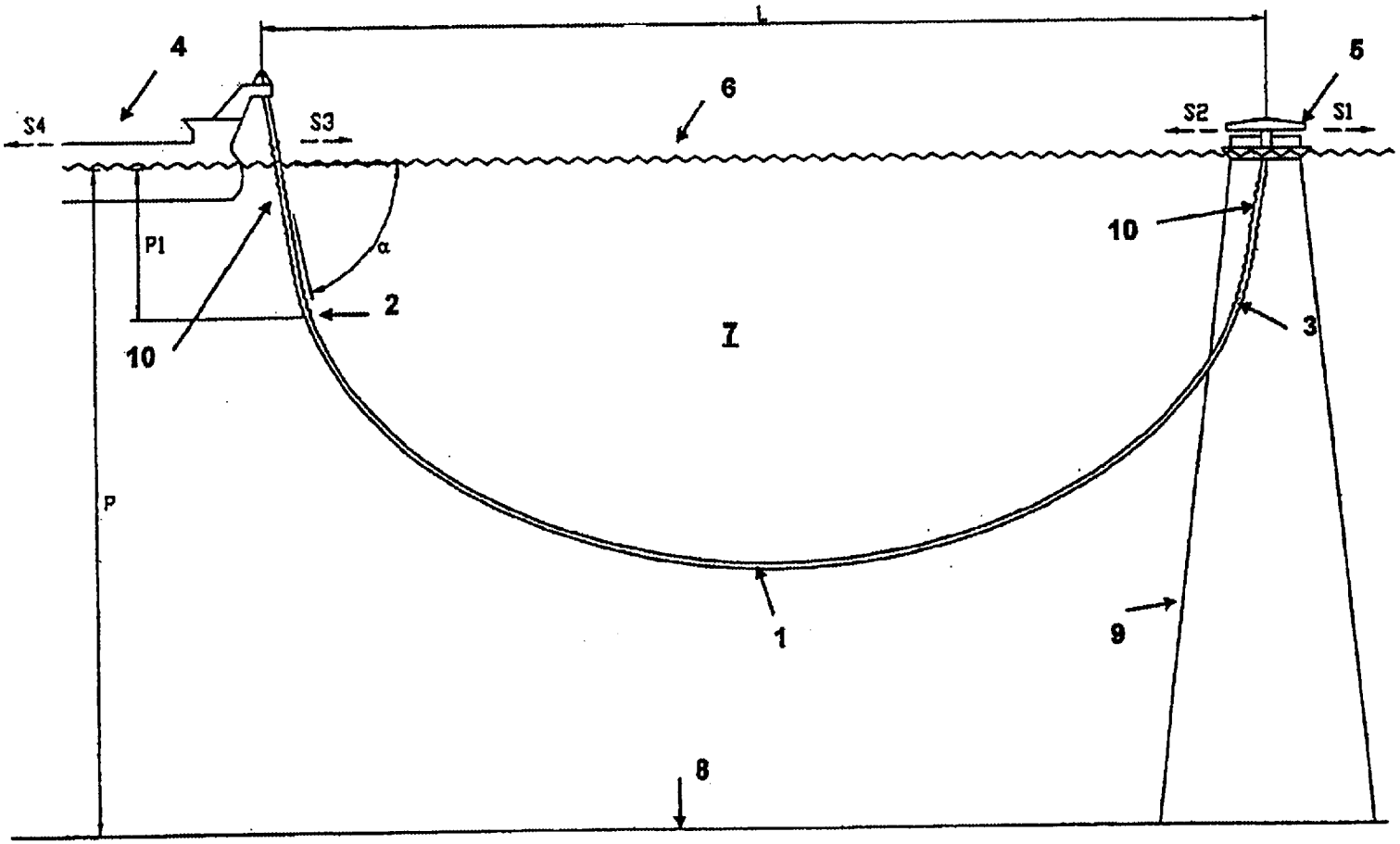
FIG. 1 is a schematic depiction of the invention according to a first embodiment.

The device according to a first embodiment of the invention depicted in FIG. 1 comprises a transport line consisting of a rigid tube 1 which is connected by each of its ends 2 and 3 to a floating support 4,5 arranged at the surface 6 of the sea 7 the depth (P) of which depends on the underwater oil field to be exploited. The support 4 is a production vessel denoted by the acronym FPSO, in which the live crude is converted into another product.

The support 5 generally consists of a CALM buoy which is anchored to the bottom 8 of the sea 7 using appropriate means 9 which will not be described and which are well known to those skilled in the art. The production vessel 4 is separated from the CALM buoy 5 by a distance L of between a few hundred meters and several kilometers. The oil tankers, not depicted, are filled with the converted product from the CALM buoy which will also not be described because it is widely used by specialists.

Each floating support 4,5 can move laterally with respect to a position of equilibrium by a distance roughly equal to 10% of the depth P. The directions of relative lateral movements are indicated by the arrows $S_1$ to $S_4$, the said lateral movements having a tendency to move the two floating supports closer together or further apart. The maximum amplitude of the relative movements between the two floating supports 4,5 may reach 20% of the depth P.

Each end 2,3 is connected to the corresponding floating support 4,5 by a connecting means 10 which, in its simplest form, consists of a flexible pipe which absorbs the dynamic stresses and takes up the tension due to the weight of the rigid pipe. In this configuration, the transport line or rigid tube 1 is curved with a radius of curvature which essentially depends on the distance L and on the relative lateral movements of the two floating supports 4 and 5. Obviously, the minimum bend radius (MBR) that the rigid tube 1 might adopt cannot be smaller than the MBR for the said rigid tube. The angle $\alpha$ at the top, under static conditions, that the export line makes with the surface 6 of the sea is between 45° and 75°.

In all cases, the ends 2 and 3 of the rigid tube 1 and the entirety of the rigid tube 1 must be located beneath the turbulent zone given for the sea in question, that is to say the zone situated at the depth P1 beneath which the effects of the swell and the marine currents such as the orbital currents are relatively small.

By virtue of the present invention, the rigid tube 1 is subjected only to tensile loads at the ends 2 and 3, which tensile loads are generated by the weight of the rigid tube and the dynamic stresses created by the relative lateral movements of the two floating supports 4 and 5. The rigid tube 1 is practically no longer subjected to the vibrations likely to be generated by the marine currents because the ends 2 and 3 are submerged at a depth P1 which is greater than the depth of the turbulent zone. As to the effects of the swell, these are absorbed by the ability that the flexible means 10 have to bend in given directions and take up the tensile loads developed in the rigid tube 1. Specifically, when the floating supports move apart in the opposite directions S1 and S4, the rigid tube is subjected to tensile forces and when they move closer together in the directions S2 and S3, bending forces are generated, which leads to the rigid tube 1 adopting a significant curvature as its ends are moved closer together.

Figure 4:
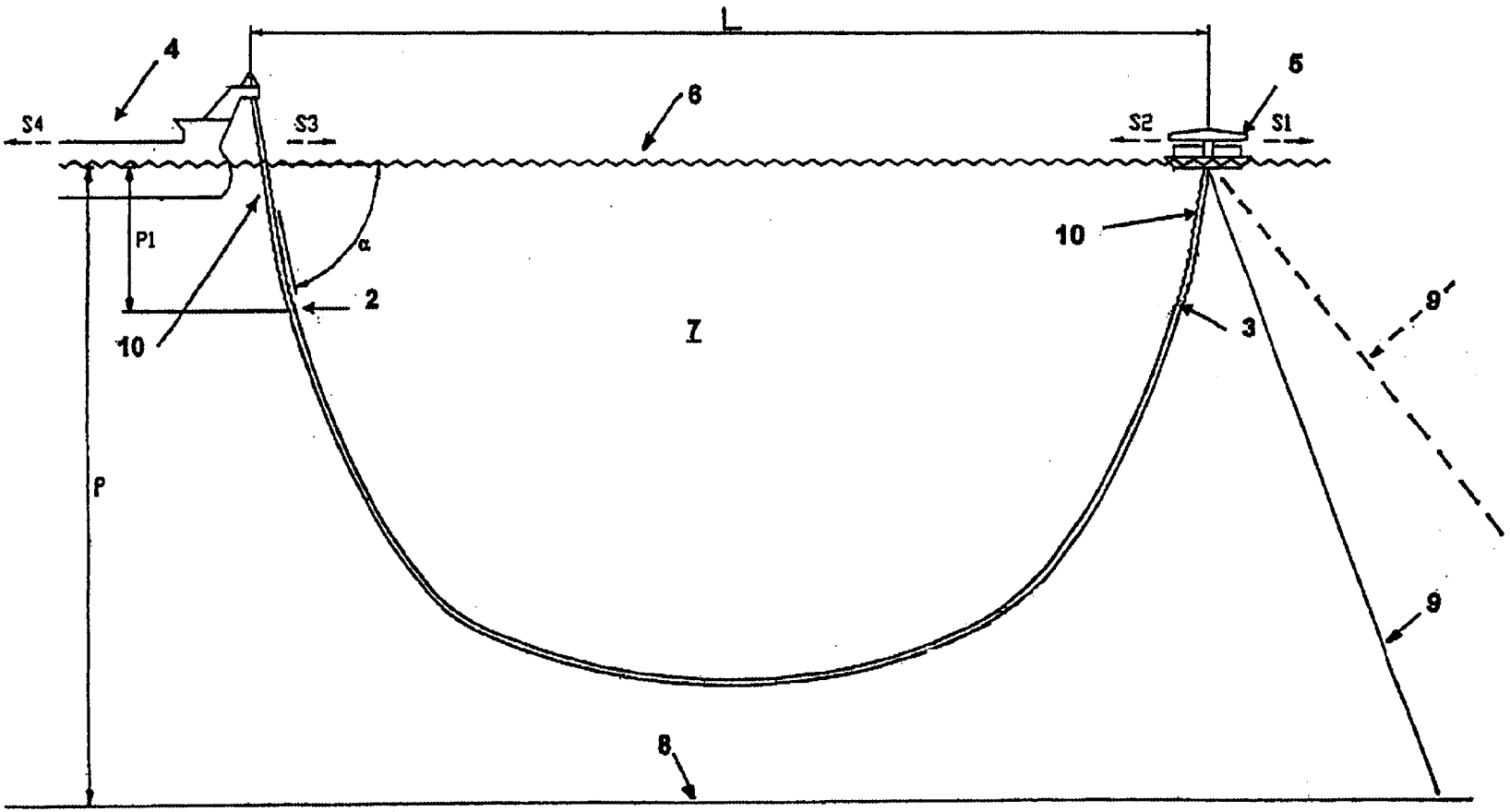
FIG. 4 is a schematic depiction of a fourth embodiment of the invention.

In another embodiment depicted in FIG. 4, it is possible to use a rigid tube 1 submerged catenary-fashion more deeply in the sea 7, so as to create relatively high tensions due to the higher weight of the rigid tube. This high weight of the rigid tube makes it possible to limit the influence that the marine currents have on the rigid pipe. Moreover, as the CALM buoy 5 is anchored to the seabed with a tension which is also high, the two types of tension due to the weight of the rigid tube and to the anchoring 9 of the CALM buoy, and optionally the additional anchoring 9', achieve equilibrium. These high tensions make it possible to stabilize the CALM buoy and consequently limit its movements in all horizontal directions. In this case, it is preferable to use an angle $\alpha$ at the top, under static conditions, between 50°and 65°and preferably equal to 60°. It should be noted, in this case, that only the other end of the export line is able to move in order to follow the movements of the floating support 4.

Figure 2:
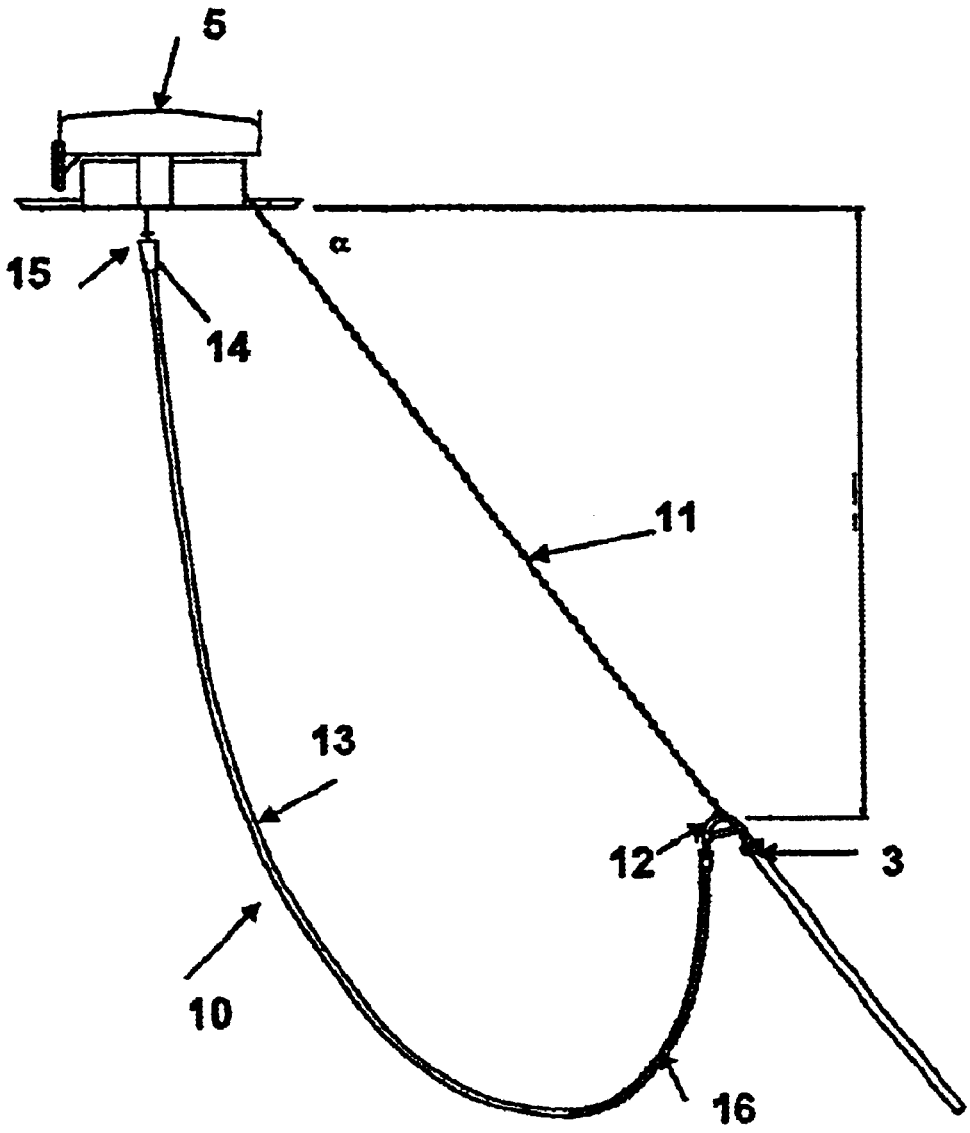
FIG. 2 is a schematic depiction of the invention according to a second embodiment.

In the embodiment depicted in FIG. 2, the connecting means 10 each consist, on the one hand, of at least one tether 11 which extends between the corresponding floating support and the end 2 or 3 of the rigid tube 1, each end 2,3 consisting of a goose neck 12 and, on the other hand, of a length of flexible pipe 13, one end 14 of which is connected to a connector 15 which, in turn, is connected to the corresponding floating support 4,5 and the other end of which is connected to the goose neck by appropriate means (connectors) to ensure the continuity of the flow of crude.

The tether 11 may consists of a chain, a textile cable, for example made of carbon, a steel cable or a nylon cord.

The tether 11 supports the weight of the rigid tube 1 and, by virtue of its flexibility, absorbs the effects of the swell, the marine currents not giving rise to any vibration because of the small diameter of the tether. The length of flexible pipe 13 allows the converted product to flow between the floating supports 4,5 and the rigid tube 1. Because of the flexibility and of its ability to deform, the length of flexible pipe 13 is capable of following the movements of the floating support to which it is connected.

The length of the length of flexible pipe 13 is greater than the length of the tether 11, the difference in length being of the order of 20%, so that it does not take any tensile force.

In one advantageous form, the length of flexible pipe is equipped, at least at one of its ends, with a bend limiter, for example vertebrae 16 or a stiffener, well known to those skilled in the art.

Figure 3:
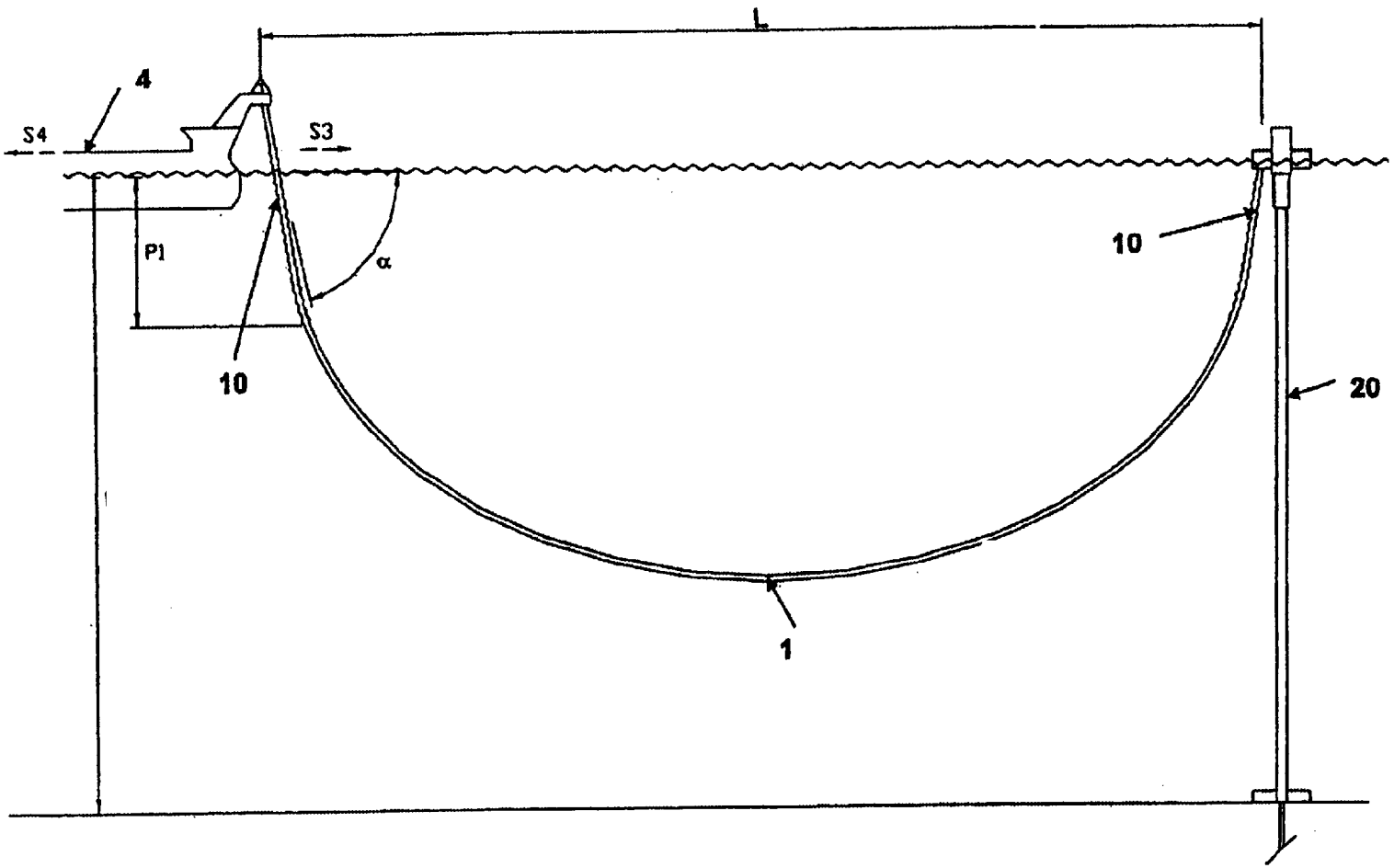
FIG. 3 is a schematic depiction of the invention according to a third embodiment.

In all the embodiments of FIGS. 1 to 3, the angle $\alpha$ at the top of the connecting means is between 45° and 75° under static conditions and between 20° and 85° under dynamic conditions. The angle $\alpha$ under dynamic conditions corresponds to the angle formed by the configuration during relative movements of the floating supports and rigid tube 1.

The range from 20° to 85° under dynamic conditions is chosen so as to limit the horizontal component of the tension created in the rigid tube 1 when the amplitude of the relative movements of the floating supports is at a maximum and so as to avoid excessive curvature beyond the MBR and thus significant fatigue of the rigid tube 1 when the amplitude of the relative movements of the floating supports is minimum.

The non turbulent zone as mentioned earlier (and hence the turbulent zone) is defined by a zone or depth of water in which the marine currents have a maximum relative speed of between 0.5 m/s and 1 m/s. The person skilled in that art will know how to determine the depth of submersion as a function of the diameter of the rigid tube and of the effects of turbulence. For example, in the case of Brazil (a zone where the speed of the marine currents is high), the turbulent zone can be as deep as 300 m, or even 500 m (15% to 25% of the water depth) in certain fields. By contrast, in West Africa (a zone where the turbulences are weak), the turbulent zone can have a maximal depth in the order of 50 m (5% of the water deep).

In FIG. 3, a fixed production tower 20, arranged over a well head, may be connected to the floating support 4 to constitute an oil production installation. In this case, the fixed tower 20 is connected to the said floating support 4 by connecting means such as those depicted in FIGS. 1 and 2 and by a rigid pipe 1 submerged catenary-fashion, the latter being entirely submerged at a depth P1 which is greater than the given turbulent zone of the sea. The length of each connecting means is greater than the depth P1.

This oil production installation is supplemented by a CALM buoy 5 (not shown in FIG. 3) which is connected to the floating support 4 by the means previously described. In this case, the live crude produced by the well head rising up into the fixed tower 20 is transferred to the floating production support 4, the treated oil then being transferred to the CALM buoy 5 from which the oil tankers are supplied.

Of course, the floating supports may just as easily consist, for example, of an oil platform, a SPAR (the acronym for a Submersible Pipe Alignment Rig) or any other oil production surface entity.

What is claimed is:

1. A device for transferring fluid between first and second separated floating supports located at the surface of the sea, wherein the sea includes a normal turbulent zone down to a first depth under the surface of the sea where the floating supports are located, the supports being moveable relatively toward and away from each other on the surface of the sea, and the transferring device comprising:

a rigid, hollow transport line having opposite ends supported by the first and second supports and the line being shaped and positioned to be submerged catenary fashion entirely below the turbulent zone of the sea;

first and second flexible connectors respectively connecting the first and second ends of the transport line to respective ones of the first and second floating supports, where each connector is capable of providing both exclusive mechanical support for the weight of the transport line, and continuity of flow of fluid between the respective one of the first and second supports and through the rigid transport line;

each connector being so shaped, of such size and so connected with the respective end of the transport line that the entire rigid transport line including the first and second ends thereof is supported submerged in the sea at a depth greater than the turbulent zone below the surface of the sea.

2. The device of claim 1, wherein each of the connectors has a length beneath the surface of the sea that is greater than the depth of the turbulent zone so that the first and second ends of the rigid transport line are at a depth greater than the depth of the turbulent zone.

3. The device of claim 1, wherein each of the first and second connectors comprises a respective flexible pipe connected between the respective one of the first and second ends of the rigid transport line and the respective one of the first and second supports.

4. The device of claim 3, wherein the connectors form an angle of between 20° and 85° with the surface of the sea.

5. The device of claim 1, wherein the connectors form an angle of between 20° and 85° with the surface of the sea.

6. The device of claim 5, wherein the connectors form an angle of between 45° and 75° with the surface of the sea.

7. The device of claim 1, wherein the connectors form an angle of between 50° and 65° with the surface of the sea for submerging the rigid tube deeply and in catenary fashion.

8. The device of claim 7, wherein the angle formed is 60°.

9. The device of claim 7, wherein the second floating support is anchored by an anchor line which extends from said second floating support in a direction angled away from said first floating support.

10. The device of claim 9, further comprising a second anchor line which also extends from said second floating support in a direction angled away from said first floating support.

11. An offshore oil production installation comprising a fixed tower fixed over a well head and at least one floating support floating on the surface of the sea spaced away from the fixed tower, and wherein the sea includes a normal turbulent zone down to a first depth under the surface of the sea;

a rigid pipe having opposite first and second ends, the pipe being submerged catenary fashion in the sea below the surface of the sea and entirely below the turbulent zone;

a first flexible connector connecting the first end of the rigid pipe to the at least one floating support; a second flexible connector connecting the second end of the rigid pipe to the fixed tower, wherein each of the first and second connectors is capable of ensuring both exclusive mechanical support for the weight of the transport line, and continuity of flow between the floating support and the fixed tower through the rigid pipe;

each connector being so sized, shaped and located and selected that the entire rigid pipe including the first and second ends thereof is submerged to at a depth in the sea greater than the depth of the turbulent zone of the sea where the floating support and the fixed tower are disposed.

12. The installation of claim 11, wherein each of the connectors has a length beneath the surface of the sea that is greater than the depth of the turbulent zone so that the first and second ends of the rigid transport line are at a depth greater than the depth of the turbulent zone.

13. A device for transferring fluid between first and second separated supports, with at least the first support being located at and floatable on the surface of the sea and moveable toward and away from the second support, wherein the sea includes a normal turbulent zone down to a first depth under the surface of the sea, the transferring device comprising:

a rigid, hollow transport line having opposite ends supported by the first and second supports and the line being shaped and positioned to be submerged catenary fashion entirely below the turbulent zone of the sea;

a respective first and second flexible connector connecting each of the first and second ends of the transport lines to a respective one of the first and second supports, where each connector is capable of providing both exclusive mechanical support for the weight of the transport line, and continuity of flow of fluid between the respective one of the first and second supports and through the rigid transport line;

each connector being so shaped, of such size and so connected with the respective end of the transport line that the entire rigid transport line including the first and second ends thereof is supported submerged in the sea to a depth greater than the turbulent zone below the surface of the sea.

14. The device of claim 13, wherein each of the connectors has a length beneath the surface of the sea that is greater than the depth of the turbulent zone so that the first and second ends of the rigid transport line are at a depth greater than the depth of the turbulent zone.

15. A method for providing a device for transferring fluid between first and second supports, where at least one of the supports is floatable at the surface of the sea, wherein the sea includes a normal turbulent zone down from the surface of the sea to a given depth, the method comprising:

determining the given depth of the turbulent zone at the location at which at least one of the supports is disposed;

selecting and defining connectors for opposite ends of a pipe such that the connectors will support the ends of the pipe entirely below the determined depth of the turbulent zone;

connecting opposite ends of a rigid hollow fluid transport line to the connectors such that the ends of the pipe are below the turbulent zone, and retaining the entire rigid transport line between the ends thereof supported exclusively by the connectors and submerged in the sea at a depth greater than the depth of the turbulent zone, the connectors being capable of providing both exclusive mechanical support for the weight of the transport line, and continuity of fluid flow between the connectors and the rigid fluid transport line.

16. The method of claim 15, further comprising supporting the rigid hollow fluid transport line submerged catenary fashion in the sea.

* * * * *